US005775553A

United States Patent [19]

Marshall et al.

[11] Patent Number: 5,775,553

[45] Date of Patent: Jul. 7, 1998

[54] INDICATOR ATTACHMENT MECHANISM

[75] Inventors: David J. Marshall, Bulleen, Australia; Roland Harmer, Centereach; Stanley F. Gouldson, Northport, both of N.Y.

[73] Assignee: Spotless Plastics Pty. Ltd., Australia

[21] Appl. No.: 688,994

[22] Filed: Aug. 1, 1996

Related U.S. Application Data

[63] Continuation-in-part of Ser. No. 595,757, Feb. 2, 1996, abandoned.

[30] Foreign Application Priority Data

Feb. 2, 1995 [AU] Australia ..... PN0888

[51] Int. Cl.[6] ..... A47G 25/14

[52] U.S. Cl. ..... 223/85; 40/322

[58] Field of Search ..... 223/85, 92, 95, 223/88; 40/322, 666; 24/614, 615, 616; 403/326, 329

[56] References Cited

U.S. PATENT DOCUMENTS

| | | |
|---|---|---|
| 921,846 | 5/1909 | Kerley . |
| 2,294,527 | 9/1942 | Weiss . |
| 2,501,940 | 3/1950 | Hibbard . |
| 2,940,145 | 6/1960 | Fernberg . |
| 3,191,770 | 6/1965 | Zuckerman . |
| 3,692,269 | 9/1972 | Hales . |
| 3,967,351 | 7/1976 | Rosenberg et al. . |
| 4,322,902 | 4/1982 | Lenthall . |
| 4,718,546 | 1/1988 | Kolton et al. . |
| 5,377,884 | 1/1995 | Zuckerman . |
| 5,449,099 | 9/1995 | Blanchard . |
| 5,477,995 | 12/1995 | Dooley et al. . |
| 5,503,310 | 4/1996 | Zuckerman et al. . |

FOREIGN PATENT DOCUMENTS

| | | |
|---|---|---|
| A 1-57011/80 | 10/1980 | Australia . |
| A-32008/84 | 2/1985 | Australia . |
| 352216 | 7/1931 | United Kingdom . |
| WO 90/09651 | 8/1990 | WIPO . |

*Primary Examiner*—Bibhu Mohanty
*Attorney, Agent, or Firm*—Scully, Scott, Murphy & Presser

[57] ABSTRACT

A molded plastic garment hanger having an improved indicator attachment device is disclosed, wherein the hanger has a hook with an upstanding web to be received within a downwardly opening cavity of a molded plastic indicator having side walls formed with openings. The web is formed with attachment means in the form of a resilient detent formed with a laterally projecting portion positioned to engage the opening to prevent removal of the indicator from the hook unless the resilient detent is physically displaced from the opening to facilitate release of indicator from the hook. In a second embodiment the indicator has end walls with retention apertures and the web is formed with attachment means in the form of at least one resilient leg extending downwardly and outwardly from the upper side portion of the web. The leg is formed with a laterally projecting portion positioned to engage the retention aperture to prevent removal of the indicator from the hook unless the resilient leg is displaced from the retention aperture to facilitate release of the indicator from the hook.

25 Claims, 3 Drawing Sheets

INDICATOR ATTACHMENT MECHANISM

This is a continuation-in-part application of U.S. Ser. No. 08/595,757 filed Feb. 2, 1996 now abandoned entitled INDICATOR ATTACHMENT MECHANISM.

FIELD OF THE INVENTION

This invention relates to improvements in indicator attachment mechanisms for molded plastic hangers, such as garment hangers.

BACKGROUND OF THE INVENTION

For purposes of displaying garments suspended on hangers in an orderly and attractive manner to the retail customer, it is often desired to affix an indicating means on the hanger in a position visible to the retail customer while the hanger is suspended on a rack. The indicating means identifies some attribute of the garment suspended from the hanger, such as size, quality, color, manufacturing data, or pattern.

The provision of a readily visible size indicator on a garment hanger is now accepted by retailers as a desirable addition to a garment hanger. To accommodate the various types of hangers available in the industry numerous indicating means have been developed in a variety of shapes, sizes and materials. Similarly, hangers have been developed to accommodate a variety of different indicating means.

In Australian Patent No. 638436 and corresponding U.S. Pat. No. 5,388,354, assigned to the assignee of the present invention, a low-profile molded plastic indicator for a garment hanger which requires limited modification to the hook of the hanger to enable the indicator to be securely attached to the top of the hook where it is most visible is described. The improvements described in the above patents overcame the major disadvantages of one type of indicator (trapezium-shaped) described in U.S. Pat. No. 4,322,902 which required a specially molded hook profile to support the indicator.

The indicator according to Australian Patent No. 638436 and U.S. Pat. No. 5,388,354 is also designed to enable sorting into a predetermined orientation to enable automated handling and fitting of the indicators to hangers as described in U.S. Pat. Nos. 5,272,806 and 5,285,566 which are assigned to the assignee of the present invention. For these reasons, the indicator has enjoyed considerable commercial success.

The indicator is retained on the hook by means of at least one abutment projecting from the hook which engages an aperture in the side wall of the indicator. While it is possible to disengage the indicator from the abutment(s) by bowing the side walls in the regions of the apertures, this is a difficult operation and often results in some damage to the indicator or to the hanger.

Furthermore, it is increasingly common for customers to require that the indicator be removable from the hanger for re-use with other sized garments or re-location and the attachment mechanism described above does not readily facilitate this operation. It is, of course, equally necessary for the indicator to remain securely attached to the hanger during the usual handling operations to which the hanger is subjected in day to day use.

SUMMARY OF THE INVENTION

Accordingly, it is an object of the present invention to provide an improved indicator attachment mechanism which securely fastens an indicator to a hanger but which permits removal of the indicator in a simple operation that reduces the likelihood of damage to the indicator or to the hanger.

The invention therefore provides a molded plastic hanger having an indicator attachment device, wherein the hanger has a hook formed with an upstanding web to be received within a downwardly opening cavity of a molded plastic indicator, and attachment means formed on the web to engage and releasably secure the indicator to the web.

In one preferred embodiment of the invention, the indicator has side walls formed with at least one aperture adapted to receive the attachment means. The attachment means preferably comprises a resilient detent means which is formed in said upstanding web and has a laterally projecting portion positioned to engage the side wall aperture of the indicator to prevent removal of the indicator from the hook. The resilient detent means also enables the laterally projecting portion to be disengaged from the opening to facilitate removal of the indicator from the hook without damage to the indicator or to the hook.

In use, as will be described more fully below, the laterally projecting portion is disengaged from the side wall by inserting a probe or pin through the side wall aperture to displace the laterally projecting portion from the aperture to thereby release the indicator from the hook.

In a particularly preferred embodiment, the detent means comprises a downwardly depending leg integrally molded within a molded opening in the upstanding web and resiliently connected to the web to enable deflection of the laterally projecting portion into the plane of the web to facilitate removal of the indicator from the web.

In another embodiment the attachment means comprises at least one resilient leg extending downwardly and outwardly from the upper region of the web. The resilient leg has an axially projecting portion positioned to engage a retention aperture in the end wall of an indicator.

Another object of the present invention is an indicator with at least one retention aperture in an end wall that can be used in conjunction with such an indicator attachment mechanism.

BRIEF DESCRIPTION OF THE DRAWINGS

The foregoing and other objects of the invention may now be more readily ascertained from the following detailed description of preferred embodiments thereof, taken in conjunction with the accompanying drawings; in which.

DETAILED DESCRIPTION OF THE PREFERRED EMBODIMENTS

Referring now in detail to the drawings, and to the embodiments depicted in FIGS. 1–10, there is illustrated generally a hook 1 adapted to engage a rod or other supporting means, with an upwardly projecting web 3 extending upwardly above the top contour la of hook 1 that engages the rod or other supporting device. An opening 5 is defined in said upwardly projecting web 3 such that upwardly projecting web 3 completely surrounds opening 5. Leg 6 descends from an upper portion 10 of the upwardly projecting web into the opening 5.

Figure 1:
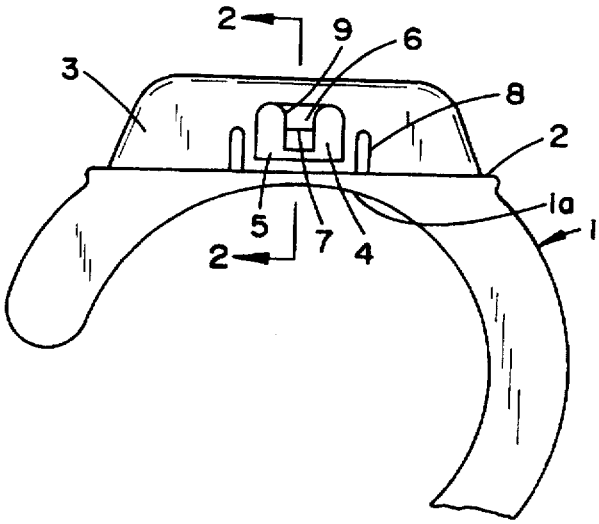
FIG. 1 is a front elevation of the hook of a hanger incorporating the improved indicator attachment mechanism embodying the invention.
Figure 2:
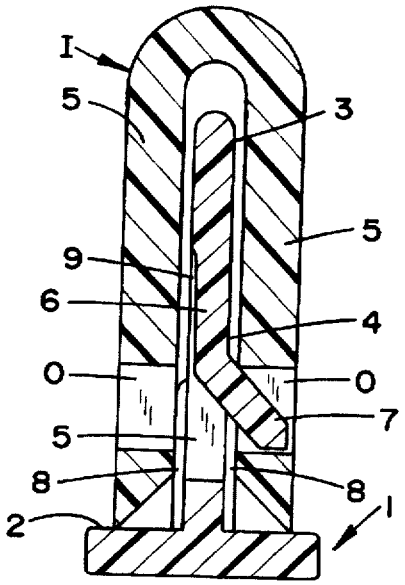
FIG. 2 is a sectional end elevation taken along line 2—2 in FIG. 1 and showing an indicator of the type described in Australian Patent No. 638436 held in place by the indicator attachment mechanism embodying the invention.
Figure 7:
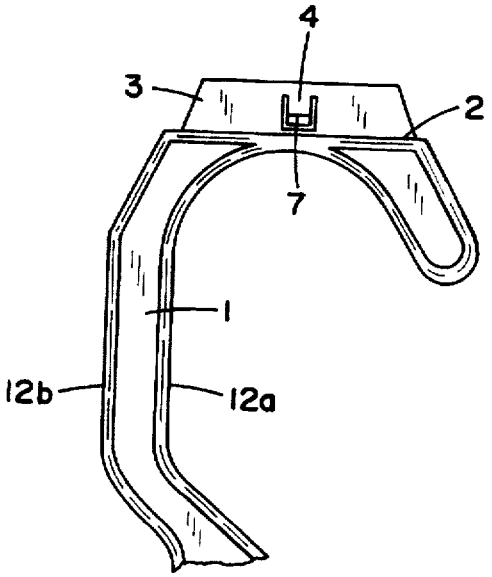
FIG. 7 is a front elevation view of a fourth embodiment of the hanger hook incorporating the indicator attachment mechanism of the present invention.
Figure 8:
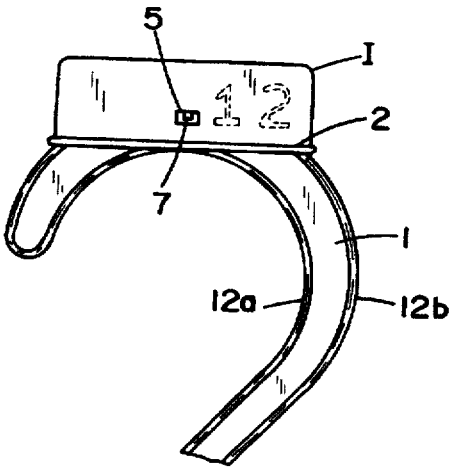
FIG. 8 is a front elevation view of a fifth embodiment of the hanger hook depicted in FIG. 1 with an indicator of the type described in Australian Patent No. 638436 and U.S. Pat. No. 5,388,354 held in place by the indicator attachment mechanism of the present invention.
Figure 9:
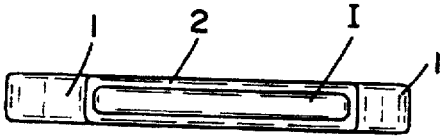
FIG. 9 is a top view of FIG. 2.

Referring to FIGS. 1 and 2 of the drawings, FIG. 1 shows a first embodiment of the hook 1 of a molded plastic garment hanger in simplified form which in practice typically includes the usual strengthening ribs 12*a*, 12*b* shown in FIGS. 7 and 8 around the perimeter of the hook. The hook 1 is formed with a flange 2 defining a top region, which in a preferred embodiment is flattened and slightly larger in peripheral dimensions than the lowermost portion of an indicator I (shown most clearly in FIGS. 2, 5 and 9) having side walls S formed with retention openings 0, as described in Australian Patent No. 638436 and U.S. Pat. No. 5,388,354, the contents of which are incorporated into this specification by cross-reference. The openings define through-openings which facilitate stacking of the indicator I with other indicators I prior to fitting to a hanger.

The upstanding web 3 extends centrally from the top region flange 2 of the hook 1, and in this embodiment the web is shaped similarly to the shape of the cavity of the indicator I so as to comfortably fit within that cavity. Alternatively, the web 3 can be configured in the manner shown in FIGS. 6 and 7 herein or Australian Patent No. 638436. In a preferred embodiment the upstanding web is narrow.

The web 3 is formed with integrally molded indicator attachment means 4. In the present embodiment the indicator attachment means includes central opening 5 from the upper portion of which a resilient detent leg 6 extends downwardly terminating in a laterally projecting portion 7 configured to engage one of the openings 0 in the side wall S of the indicator I, as shown in FIG. 2 of the drawings. In FIG. 8 illustrates a front elevation view of an indicator I (of the type described in Australian Patent No. 638436 and U.S. Pat. No. 5,388,354) affixed to a hook 1 incorporating the indicator attachment means 4 of the present invention.

Since the detent leg 6 is narrow and is resiliently connected to web 3, it is easily deflected laterally by means of a probe or pin inserted into the opening 0 which engages laterally projecting portion 7 to displace laterally projecting portion 7 toward the plane of the web to clear the opening 0 and allow the indicator I to be removed from the web 3. This operation can be achieved simply and quickly with little or no damage to the indicator I or the attachment means 4. Nevertheless, while the laterally projecting portion 7 remains in the position shown in FIG. 2 of the drawings, the indicator I will remain securely fastened to the web 3 and will withstand all usual handling operations to which the hanger is usually subjected in day-to-day use.

To improve the flexibility of the detent leg 6, it can be reduced in thickness as shown at 9 in FIG. 2 of the drawings.

The upstanding web 3 of the hook 1 is further formed with a pair of ribs 8 on either side of the central opening 5 to prevent the indictor I from being inadvertently laterally displaced to clear the laterally extending portion 7.

Figure 3:
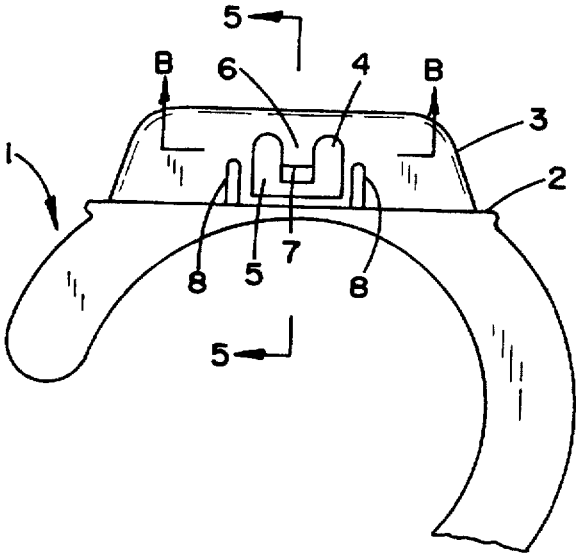
FIG. 3 is a fragmentary front elevation similar to FIG. 1 showing a second embodiment of the indicator attachment mechanism.
Figure 5:
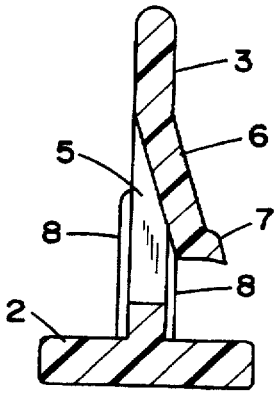
FIG. 5 is a sectional view taken along line 5—5 of FIG. 3.
Figure 4:
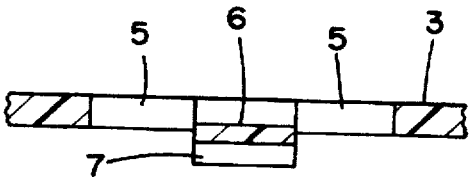
FIG. 4 is a partial sectional view taken along line B—B of FIG. 3.

Referring now to FIGS. 3 to 5 of the drawings, a modified embodiment of the invention is shown in which the same reference numerals are used to indicate similar parts. In this embodiment, the resilient detent leg 6 extends angularly from its point of attachment to the web 3, as shown most clearly in FIGS. 4 and 5 of the drawings, and has a shorter laterally extending portion 7 formed at its free end.

Figure 6:
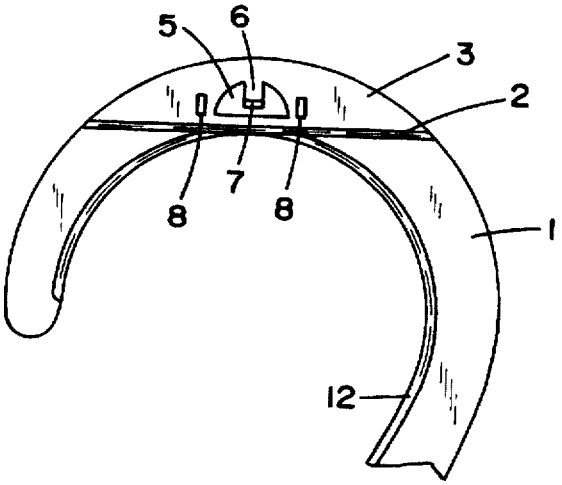
FIG. 6 a front elevation view of a third embodiment of the hanger hook incorporating the indicator attachment mechanism of the present invention.

FIG. 6 illustrates a third embodiment of the present invention wherein the upstanding web 3 of the hook 1 is further formed with a pair of ribs 8 on either side of a central semi-circular opening 6 to prevent the indicator (not shown) from being inadvertently laterally displaced to clear the laterally projecting portion 7 which engages the aperture of an indicator similar to that shown in FIG. 2 of the drawings.

Figure 10:
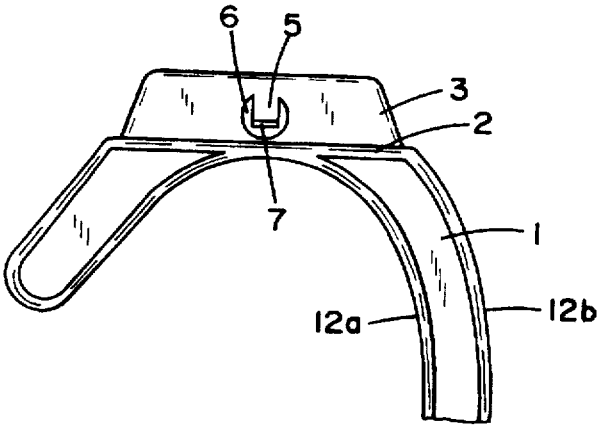
FIG. 10 is a front elevation view of a sixth embodiment of the hanger hook depicted in FIG. 1.
Figure 14:
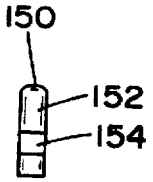
FIG. 14 is a side view of the indicator shown in FIGS. 12 and 13.

FIG. 10 illustrates another embodiment of the present invention wherein the upstanding web 3 of the hook 1 is further formed with a central circular opening 6 to prevent the indicator (not shown) from being inadvertently laterally displaced to clear the laterally projecting portion 7 which engages the aperture of an indicator similar to that shown in FIG. 2 of the drawings. The circular opening 6 avoids flow eddies and facilitates flow of the plastic material in the mold during molding and thus adds strength to the web area of the hanger. This improves the retention of the indicator on the hanger hook by strengthening the projecting portion 7 and the surrounding web.

FIG. 7 illustrates the hook 1 of the present invention in which flange 2 is integrally formed as part of strengthening rib 12, and extends around the perimeter of the hook 1.

In the present invention the upstanding web 3 formed on the hook 1 of the hanger can be shaped and dimensioned similar to the shape of the cavity of the indicator I so as to comfortably fit within that cavity. By the same token, as depicted in FIG. 6, upstanding web 3 can also be formed in the "normal" shape of the shape of the hook 1 so the hanger can be used with or without the indicator. The web can also be configured in the manner shown in Australian Patent No. 638436 and U.S. Pat. No. 5,388,354 or in any other manner to accommodate the cavity dimensions of any other type of indicator, including indicators that have angled or sloping end walls to conform to the angularity of the hook design.

The indicator attachment mechanism described in the above embodiments provides a particularly simple and convenient means of retaining the indicator I on the web 3 of the hook 1 while enabling the indicator I to be conveniently removed in a simple operation which does not significantly damage either the indicator I or the hook 1 of the hanger. In this way, the disadvantages associated with the attachment mechanism described in our Australian Patent No. 638436 and U.S. Pat. No. 5,388,354 are overcome in a simple but innovative manner.

Referring now in detail to the drawings, and to the embodiments depicted in FIGS. 11–15, there is illustrated generally a hook 101 adapted to engage a rod or other supporting means, with an upwardly projecting web 103 extending upwardly above the top contour 101*a* of the hook 101 that engages the rod or other supporting device. At least one leg 106 extends outwardly and downwardly from at least one side 120 of the upwardly projecting web 103.

Figure 11:
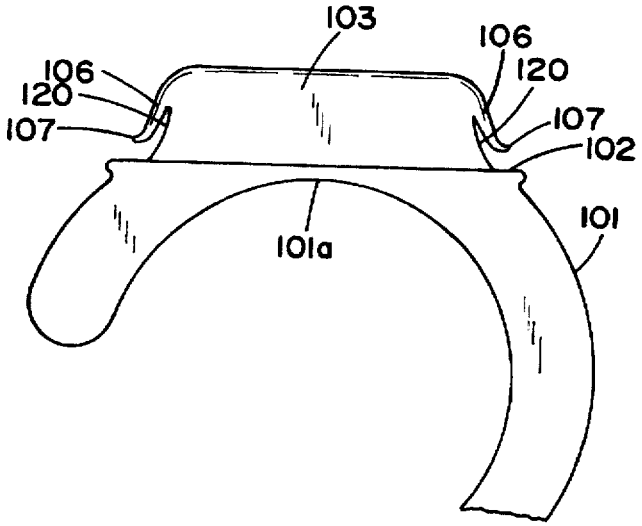
FIG. 11 illustrates a front elevation view of the hook of a hanger incorporating still another indicator attachment mechanism.

FIG. 11 shows an embodiment of the hook 101 of a molded plastic garment hanger in simplified form which in practice typically includes the usual strengthening ribs 112*a*, 112*b* around the perimeter of the hook. The hook 101 is formed with a flange 102 defining a top region, which in a preferred embodiment is flattened and slightly larger in peripheral dimensions than the lowermost portion of an indicator 150 (shown in FIGS. 12–14) having at least one end wall 152 formed with at least one retention aperture 154.

The upstanding web 103 extends axially along the longitudinal axis of the hanger and extends centrally from the top region 102 of the hook 101, and in this embodiment the web is shaped similarly to the shape of the cavity of the indicator 150 so as to comfortably fit within that cavity. Alternatively, the web 103 can be configured in the manner shown in FIGS. 6 and 7 herein or Australian Patent No. 638436.

Figure 12:
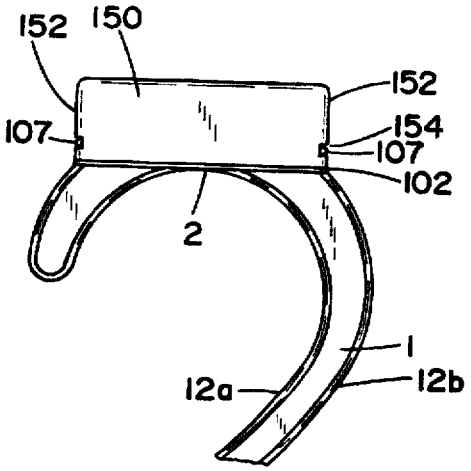
FIG. 12 is a front elevation view of the indicator attachment mechanism of FIG. 11 with an indicator held in place by the indicator attachment mechanism of the present invention.

The web 103 is formed with an integrally molded indicator attachment means, which in the present embodiment includes at least one resilient leg 106 terminating in an axially projecting portion 107 which extends the axial dimension of the web and which is configured to engage an opening 154 in the end wall 152 of an indicator 150, as shown in FIG. 12.

Since the leg 106 is narrow and is resiliently connected to web 103, it can be easily deflected downwardly and inwardly by the indicator upon placement of the indicator on the hanger hook as well as by means of a probe or pin inserted into the retention aperture 154 which engages the axially projecting portion 107 to displace axially projecting portion 107 toward the web to clear the retention aperture and allow the indicator 150 to be removed from the web 103. This operation can be achieved simply and quickly with little or no damage to the indicator 150 or the attachment means. Nevertheless, while the axially projecting portion 107 remains in the position shown in FIG. 12 of the drawings, the indicator will remain securely fastened to the web 103 and will withstand all usual handling operations to which the hanger is typically subjected to in day-to-day use.

Figure 15:
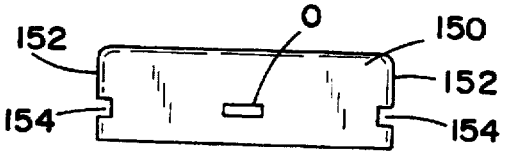
FIG. 15 is a second embodiment of the indicator shown in FIGS. 12–14.
Figure 13:
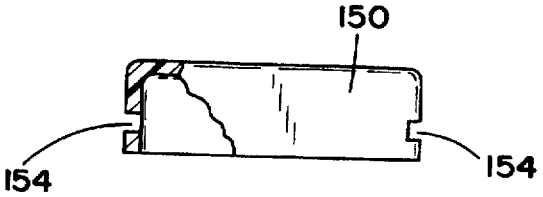
FIG. 13 is a partial section view of the indicator shown in FIG. 12.

In a preferred embodiment indicator 150 is formed with a retention aperture 154 in each of its end walls 152 and also with openings 0 as described in Australian Patent No. 638436 and U.S. Pat. No. 5,388,354. As discussed previously, openings 0 are through-openings which facilitate stacking of the indicator with other indicators prior to fitting to a hanger. Indicator 150 shown in FIG. 15 is extremely versatile and can be used with the indicator attachment mechanism of FIGS. 1–10 as well as the indicator attachment mechanism of FIGS. 11–15. The indicator of FIG. 15 can also be used with automated equipment in the attachment and removal of the indicator from a hanger.

In the preferred embodiment, the improved hanger hook of the present invention is formed of styrene which provides a clear virtually transparent hanger for maximum display of garments suspended therefrom. Alternately, the hanger could be formed from K resin, H. I. styrene, polypropylene or other suitable thermoplastic.

While there have been shown and described what are considered to be the several preferred embodiments of the invention, it will, of course, be understood that various modifications and changes in form or detail can readily be made without departing from the spirit of the invention. It is therefore intended that the invention not be limited to the exact form and detail herein shown and described nor to anything less than the whole of the invention herein disclosed as hereinafter claimed.

What is claimed is:

1. A molded plastic hanger having an indicator attachment device, said hanger having a hook formed with an upstanding web to be received within a downwardly opening cavity of a molded plastic indicator, and attachment means formed on said upstanding web to engage and releasably.

2. The hanger of claim 1, wherein said resilient detent means comprises an integrally molded leg extending from an opening formed in said upstanding web and terminating in said resiliently mounted laterally projecting portion.

3. The hanger of claim 2, wherein said laterally projecting portion is formed to extend outwardly of said upstanding web beyond the plane defined by a side of said web.

4. The hanger of claim 2, wherein said opening has a top edge, a bottom edge and side edges and said leg extends downwardly from said top edge.

5. The hanger of claim 2, wherein said opening defined by said upstanding web is substantially semi-circular.

6. The hanger of claim 2, wherein said opening defined by said upstanding web is substantially square.

7. The hanger of claim 2, wherein said upstanding web is substantially rectangular in configuration.

8. The hanger of claim 2, wherein said upstanding web is shaped and dimensioned to correspond to the top contour of the hook.

9. The hanger of claim 1, wherein said attachment means permits disengagement of said attachment means from said indicator to facilitate removal of the indicator from said hook without damage to said indicator or to said hook.

10. In combination, an indicator and a hanger with an improved indicator attachment device, said hanger comprising a hook formed with an upstanding web and an indicator attachment means formed on said upstanding web to engage and releasably secure said indicator to said web; and said indicator comprising side walls formed at least one opening adapted to receive said attachment means for retaining said indicator on said upstanding web of said hook, wherein said attachment means comprises a resilient detent means formed in said upstanding web and having a spring biased resiliently mounted laterally extending portion positioned to engage said side wall opening to prevent removal of said indicator from said hook, said resilient detent means enabling said laterally extending portion to be disengaged from said opening to facilitate removal of said indicator from said hook without damage to said indicator or to said hook.

11. The combination of claim 10, wherein said indicator has aligned apertures in opposite side walls positioned to receive said laterally extending portion in either of said openings, said apertures facilitating stacking with other indicators prior to engagement with said upstanding web.

12. The combination of claim 10, wherein said resilient detent means comprises an integrally molded leg extending from an opening formed in said upstanding web and terminating in said spring biased resiliently mounted laterally projecting portion.

13. The combination of claim 12, wherein said laterally projecting portion is formed to extend outwardly of said upstanding web beyond the plane defined by a side of the web.

14. A hanger having an indicator for identifying at least one characteristic of an object to be engaged with said hanger, said hanger comprising a hook formed with an upstanding web shaped to be received with a cavity of said indicator, an indicator attachment means formed on said upstanding web, said attachment means comprising a sprina biased resilient detent means terminating in a resiliently mounted laterally projecting portion and being formed to releasably engage an opening formed in a side wall of said indicator to inhibit removal of said indicator from said hook while enabling disengagement of said attachment means from said opening to facilitate removal of the indicator from said hook without damage to said indicator or to said hook.

15. The hanger of claim 14, wherein said indicator has aligned openings in opposite side walls positioned to receive said attachment means in either of said openings, said openings defining a throughopening which facilitates stacking with other indicators prior to engagement with said upstanding web.

16. The hanger of claim 14, wherein said laterally extending portion is positioned to engage said side wall opening to prevent removal of said indicator from said hook, said sprina biased resilient detent means enabling said laterally extending portion to be disengaged from said opening to facilitate removal of said indicator from said hook without damage to said indicator or to said hook.

17. The hanger of claim 16, wherein said resilient detent means comprises an integrally molded leg extending from an opening formed in said upstanding web and terminating in said resiliently mounted laterally projecting portion.

18. The hanger of claim 17, wherein said opening in said web has a top edge, a bottom edge and side edges, and said leg extends downwardly from said top edge.

19. The hanger of claim 16, wherein said laterally projecting portion is formed to extend outwardly of said upstanding web beyond the plane defined by one side of said web.

20. The hanger of claim 2, wherein said opening defined by said upstanding web is substantially circular.

21. The hanger of claim 1, wherein said attachment means comprises an integrally molded spring biased resilient leg extending outwardly from said upstanding web and terminating in an axially projecting portion.

22. In combination, an indicator and a hanger with an improved indicator attachment device, said hanger comprising a hook formed with an upstanding web, said web having an axial dimension and an indicator attachment means formed on said upstanding web to engage and releasably secure said indicator to said web; and said indicator comprising side walls and end walls, said end walls formed with at least one opening adapted to receive said attachment means for retaining said indicator on said upstanding web of said hook, wherein said attachment means comprises an integrally molded spring biased resilient leg extending outwardly from said upstanding web and terminating in an axially projecting portion.

23. The combination of claim 22, wherein said spring biased resilient leg is integrally molded with said web and extends outwardly and downwardly from said upstanding web with an axially projecting portion.

24. The combination of claim 23, wherein said web includes first and second end walls, with first and second spring biased resilient legs which extend outwardly and downwardly from said upstanding web.

25. The combination of claim 24, wherein said indicator includes first and second openings in said end walls, to receive the first and second spring biased resilient legs formed on said web.

* * * * *

UNITED STATES PATENT AND TRADEMARK OFFICE

CERTIFICATE OF CORRECTION

PATENT NO. : 5,775,553

DATED : July 7, 1998

INVENTOR(S) : David J. Marshall, et al.

It is certified that error appears in the above-identified patent and that said Letters Patent is hereby corrected as shown below:

Column 6, line 18, Claim 1: after "releasably" insert --secure said indicator to said web, wherein said attachment means comprises a spring biased resilient detent means formed in said upstanding web, said spring biased resilient detent means terminating in a resiliently mounted laterally projecting portion--

Column 7, line 13, Claim 14: "sprina" should read --spring--

Column 7, line 29, Claim 16: "sprina" should read --spring--

Signed and Sealed this

Twelfth Day of September, 2000

*Attest:*

Q. TODD DICKINSON

*Attesting Officer*

*Director of Patents and Trademarks*